United States Patent [19]

Hastie

[11] Patent Number: 4,869,484

[45] Date of Patent: Sep. 26, 1989

[54] SIGNATURE OPENING APPARATUS

[75] Inventor: Ronald W. Hastie, Elk Grove Village, Ill.

[73] Assignee: R. R. Donnelley & Sons Company, Chicago, Ill.

[21] Appl. No.: 179,887

[22] Filed: Apr. 11, 1988

[51] Int. Cl.[4] ..... B65H 39/02

[52] U.S. Cl. ..... 270/54; 270/58

[58] Field of Search ..... 270/54, 55, 56, 57, 270/58

[56] References Cited

U.S. PATENT DOCUMENTS

| | | | |
|---|---|---|---|
| 3,544,097 | 12/1970 | Linden | 270/54 |
| 3,554,532 | 1/1971 | Cosgrove et al. | 270/54 |
| 3,717,337 | 2/1973 | McCain et al. | 270/54 |
| 3,880,418 | 4/1975 | Swanson | 270/54 |
| 4,085,927 | 4/1978 | Müller | 270/54 |
| 4,162,066 | 7/1979 | McCain et al. | 270/54 |
| 4,564,186 | 1/1986 | Clarke, Jr. et al. | 270/54 |
| 4,625,952 | 12/1986 | Schniter | 270/54 |
| 4,706,950 | 11/1987 | Ruetschle et al. | 270/54 |

*Primary Examiner*—Robert E. Garrett
*Assistant Examiner*—Therese M. Newholm
*Attorney, Agent, or Firm*—Wood, Dalton, Phillips, Mason & Rowe

[57] ABSTRACT

A signature opening apparatus for receiving one signature at a time from a source of signatures fed to the apparatus in a steady stream. The apparatus includes an opening drum mounted for rotation on a shaft for delivering opened signatures to a continuous signature carrying chain. It utilizes at least one gripper assembly mounted for rotation with the opening drum for opening one signature at a time. The apparatus also includes a timing mechanism to allow the gripper assembly to initiate gripping of signatures at a first preselected point, to fully grip signatures at a second preselected point and to release signatures at a third preselected point. The gripper assembly includes an elongated countinuously curved finger having a first end mounted for rotation relative to the opening drum and a second end normally projecting beyond the opening drum. The apparatus also includes a seat as a part of the gripper assembly to be engaged by the second end of the finger. The gripper assembly is formed with the finger having a continuously curved inner surface and a continuously curved outer surface. It utilizes the timing mechanism to allow the finger to rotate from a position where the second end normally projects beyond the opening drum in spaced relation to the seat to a position where the second end cooperates with the seat to grip signatures therebetween. Additionally, the apparatus utilizes a mechanism for rotating the finger back to the position where the second end of the finger normally engages the seat.

16 Claims, 3 Drawing Sheets

FIG. 1
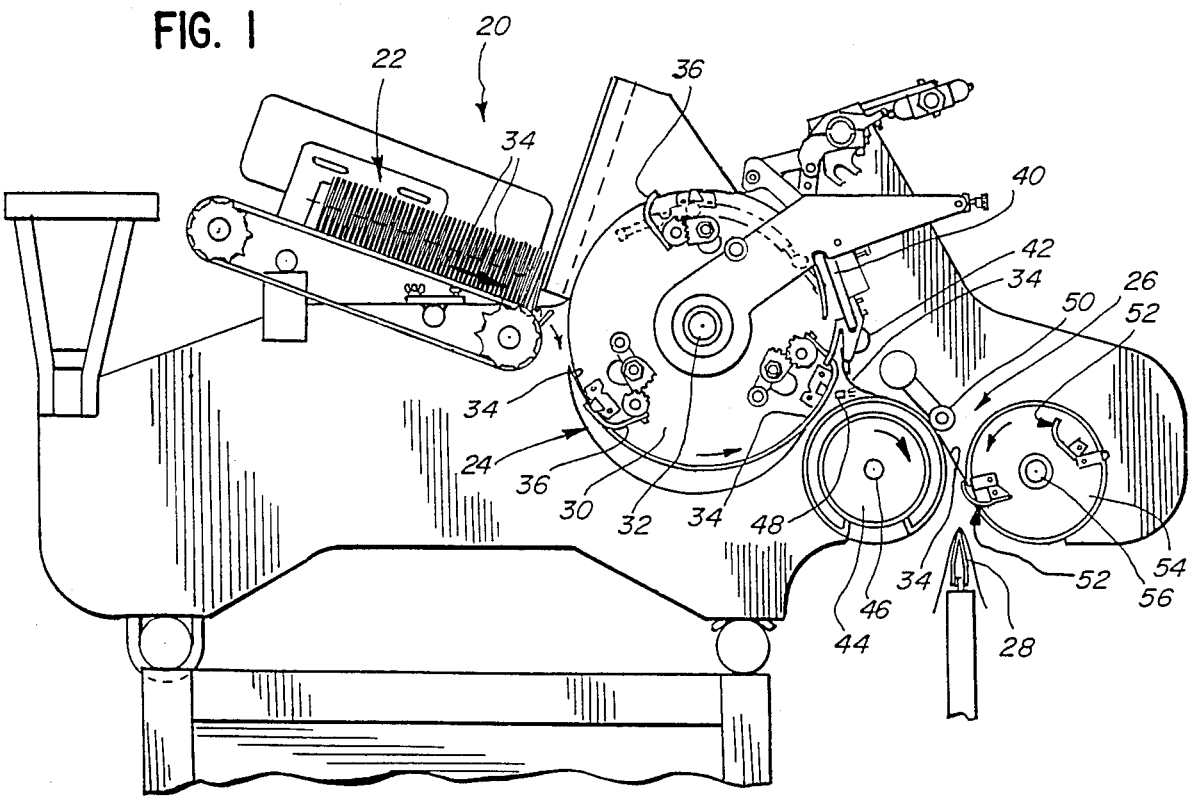
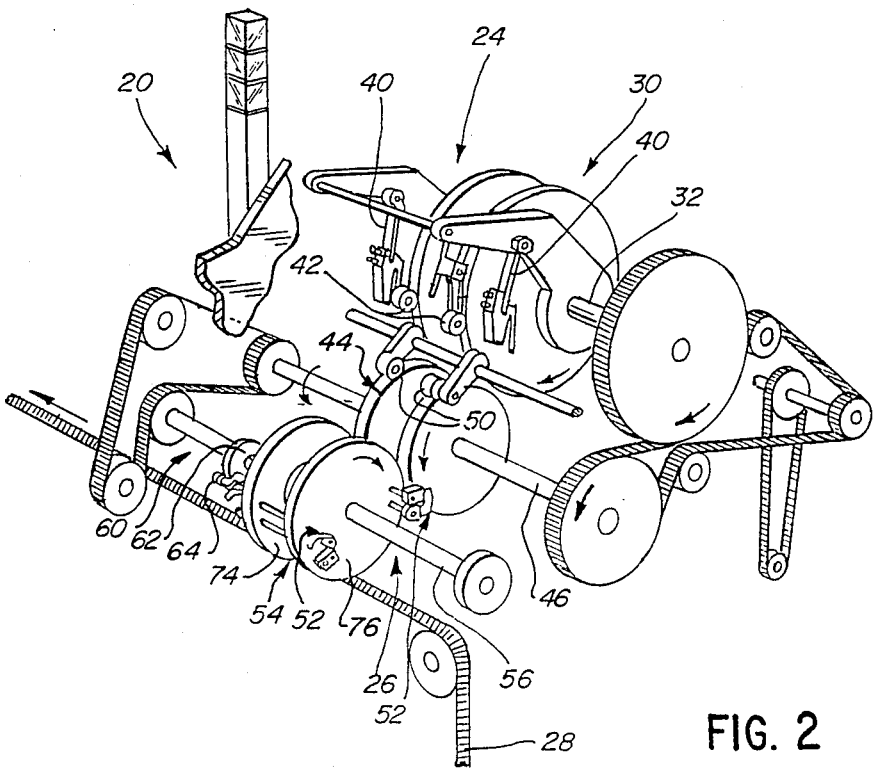
FIG. 2

FIG. 3
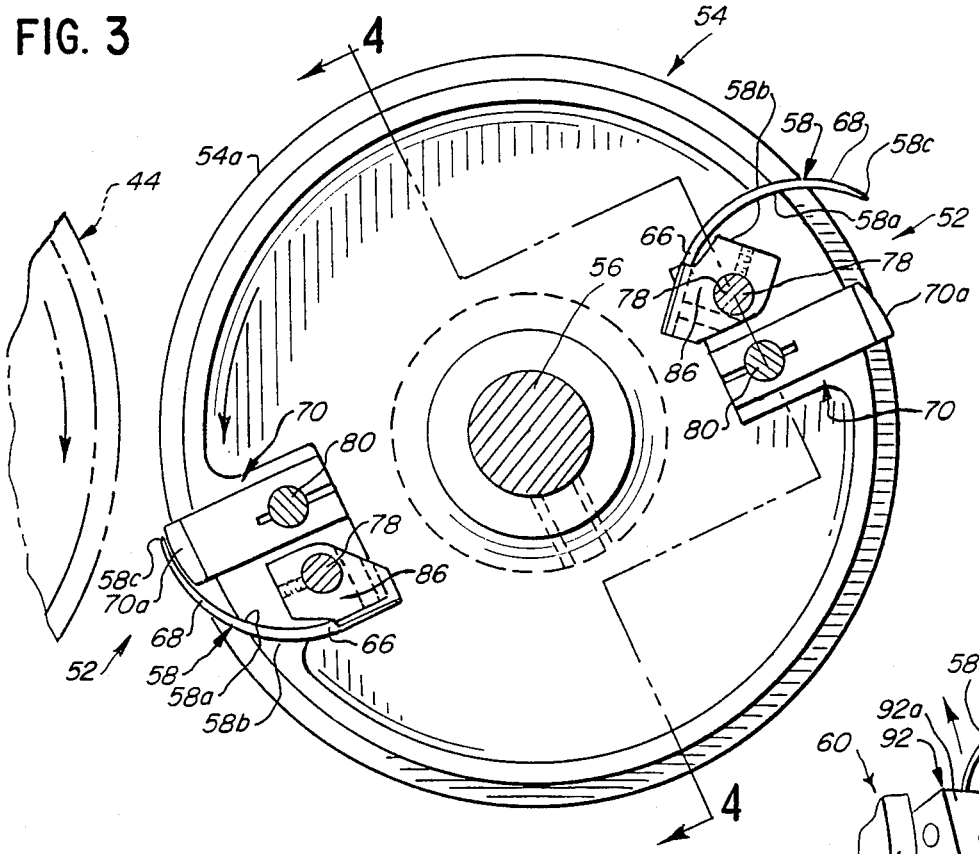
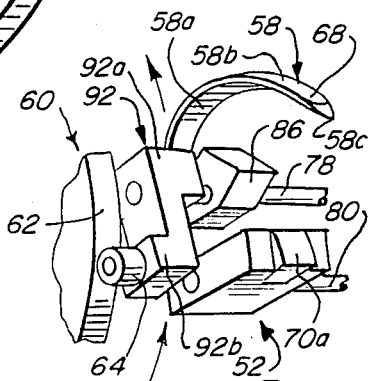
FIG. 5
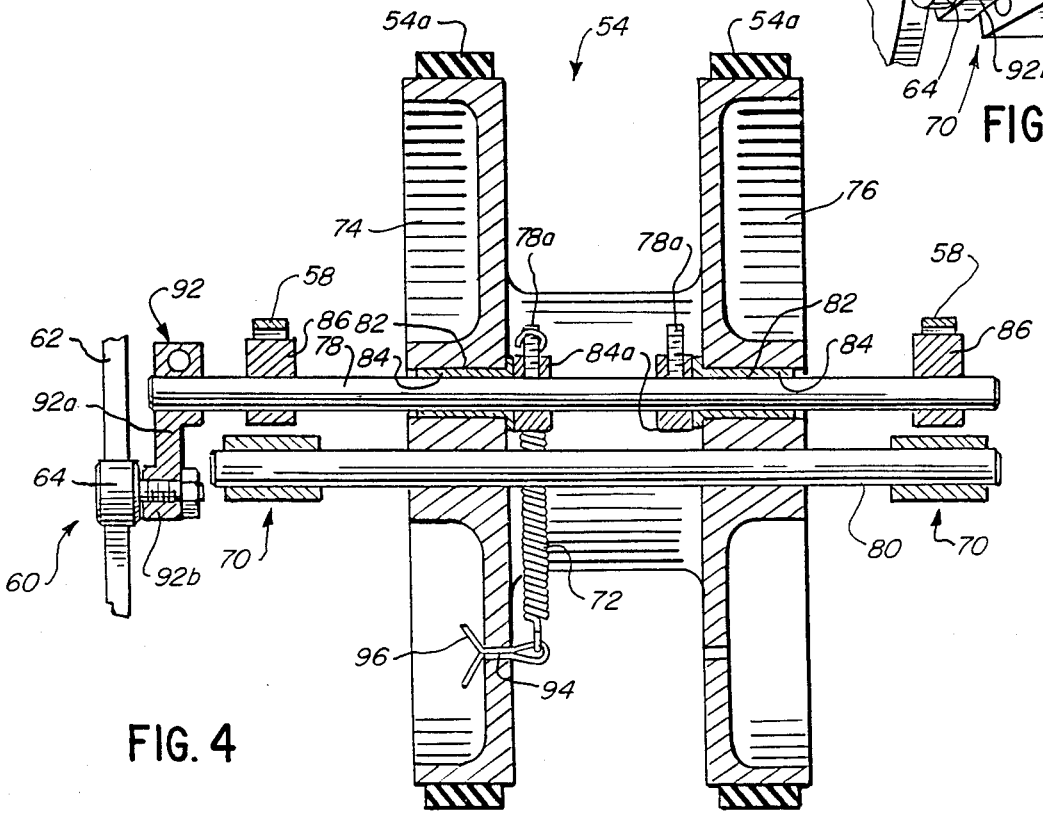
FIG. 4

SIGNATURE OPENING APPARATUS

FIELD OF THE INVENTION

The present invention relates generally to apparatus for handling signatures and more particularly, to a signature opening apparatus for delivering opened signatures to a signature carrying chain.

BACKGROUND OF THE INVENTION

In recent years, many large circulation periodicals have appeared which require rapid handling of portions of the periodicals consisting of signatures which are gathered for stitching, trimmed, bundled for minimum shipping costs, and shipped. A typical operation utilizes a multitude of packer boxes each of which receives signatures seriatum from a signature supply means, opens each signature, and drops the signatures successively straddling a gathering chain that runs in front of the packer boxes and carries the complete collection of gathered signatures to the stitcher. Moreover, because of the need for highly efficient plant operations, there has been a constant effort to increase the speed at which machines operate which has required the development of new techniques for handling the signatures at all stages of a binding process.

Unfortunately, there have sometimes been serious problems at a particular stage of the binding process. Specifically, it is well known that oftentimes it is difficult if not impossible to open signatures before they are dropped onto the gathering chain. This, of course, either results in incomplete collections of gathered signatures which must be rejected at or before the stitcher or results in a chokeup that can shut down a bindery line thereby seriously decreasing plant efficiency with a resultant increase in costs. Normally, it follows that the high volume presently produced by the U.S. printing industry cannot then be maintained and the most efficient possible use of manpower, equipment and plant space is then not made. Presently, it is well known that unopened signatures are principally caused by two different problems.

First, static is known to be a problem in bindery lines. While this is normally a problem in the press room, it can also be a significant source of difficulty in a binder line since the presence of static tends to keep the signatures closed despite the existence of grippers that are designed to open the signatures immediately before they are dropped to the gathering chain. If unopened, the signatures cannot straddle the gathering chain and will simply fall out onto the floor.

In a typical bindery line, there may be on the order of twenty-four packer boxes in operation in the line. Thus, if static is a problem, any one or more of the packer boxes may be subject to chokeup at any given time or, alternatively, signatures will be missing from what should be a complete collection of gathered signatures at the stitcher and this is a particularly serious problem when it occurs at random along the bindery line. Clearly, the grippers that have been utilized to open signatures have not successfully overcome this problem.

Second, there is the problem of dealing with pinholes in signatures to be opened. Specifically, it is known that the impaling pins used on signature folding devices can rivet signatures shut usually along the foot of the signature particularly when the impaling pins have been bent or are dull. When this occurs, conventional grippers have been highly unsatisfactory for opening signatures.

In essence, conventional grippers have had neither the reach nor the action that is needed to deal with static or pinholes. It has, thus, remained to improve apparatus design for opening signatures to be dropped so as to successively straddle the gathering chain. Accordingly, the present invention has as its principal object to successfully provide for improved signature opening.

SUMMARY OF THE INVENTION

In particular, the present invention is directed to an apparatus for receiving one signature at a time from a source of signatures fed to the apparatus in a steady stream. The apparatus includes an opening drum mounted for rotation on a shaft for delivering opened signatures to a continuous signature carrying chain. It also includes at least one gripper assembly mounted for rotation with the opening drum for opening one signature at a time. The apparatus further includes timing means for allowing the gripper assembly to initiate gripping of signatures at a first preselected point, to fully grip and open signatures at a second preselected point, and to release opened signatures at a third preselected point. With this arrangement, the present invention utilizes a gripper assembly having an elongated continuously curved finger and a seat adapted to be engaged by the finger.

More particularly, the finger has a first end mounted for rotation with and relative to the opening drum and a second end normally projecting beyond the opening drum. It also has a continuously curved inner surface and a continuously curved outer surface converging adjacent the second end. As will be understood, the seat is also mounted for rotation with the opening drum and is adapted to be engaged by the second end of the finger when it rotates relative to the opening drum.

Further, the seat has a gripping surface positioned radially relative to the shaft in a position generally corresponding to the radial extent of the outer periphery of the opening drum. The finger is adapted to rotate in one direction relative to the seat to grip the signatures therebetween. In this connection, the timing means allows the finger to rotate from a position where the second end normally projects beyond the opening drum in spaced relation to the gripping surface of the seat to a position where the second end cooperates with the gripping surface of the seat to grip signatures therebetween.

Preferably, the finger is disposed relative to the opening drum such that the curvature adjacent the second end of the finger generally conforms to the curvature of the outer periphery of the opening drum when the second end of the finger cooperates with the gripping surface of the seat to grip signatures therebetween. Furthermore, the apparatus includes means for rotating the finger from the position where the second end of the finger normally projects beyond the opening drum in spaced relation to the gripping surface of the seat to fully release the signatures from therebetween to the position where the second end of the finger cooperates with the gripping surface of the seat to grip signatures therebetween, which movement is allowed by the timing means. For this purpose, the timing means allows the rotating means to cause the finger to rotate toward the gripping surface of the seat to partially close at the first preselected point, allows the rotating means to cause the finger to further rotate toward the gripping surface to fully close at the second preselected point, and causes the finger to rotate away from the gripping surface of the seat to fully open at the third preselected point.

Preferably, the timing means includes a cam mounted in a fixed position in proximity to the opening drum and a cam follower operatively associated with the finger and mounted for rotation with the opening drum. The cam advantageously includes a first distinct cam portion at the first preselected point having a profile allowing the finger to rotate from the position where the second end of the finger normally projects beyond the opening drum to a position approaching the gripping surface of the seat where the finger is slightly spaced from the gripping surface of the seat prior to the point where the second end of the finger grips signatures therebetween. The cam also advantageously includes a second distinct cam portion at the second preselected point having a profile allowing the finger to rotate from the position approaching the gripping surface of the seat to the position where the second end of the finger cooperates with the gripping surface of the seat to grip signatures therebetween. Further, the cam includes a ramp intermediate the first and second distinct cam portions to introduce a delay between the position where the finger partially closes and the position where the finger fully closes against the gripping surface of the seat.

Still other objects, advantages and features of the present invention will become apparent from a consideration of the following specification taken in conjunction with the accompanying drawings.

BRIEF DESCRIPTION OF THE DRAWINGS

FIG. 1 is a side elevational view of a packer box utilizing a signature opener in accordance with the present invention;

FIG. 2 is a perspective view of the packer box as illustrated in FIG. 1;

FIG. 3 is a side elevational view illustrating the signature opener of FIG. 1;

FIG. 4 is a cross-sectional taken on the line 4—4 of FIG. 3;

FIG. 5 is a perspective view illustrating a gripper assembly in accordance with the present invention;

DETAILED DESCRIPTION OF THE PREFERRED EMBODIMENT

Figure 6:
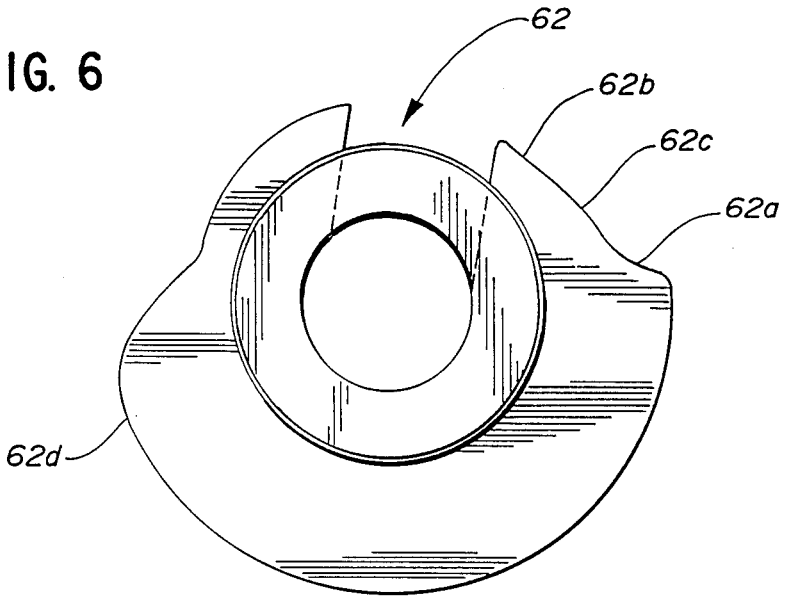
FIG. 6 is a side elevational view illustrating a cam for operating the gripper assembly of FIG. 5.

Referring to the drawings, and first to FIG. 1, the reference numeral 20 designates generally a conventional packer box having a signature feeding station 22, a main drum assembly 24, a delivery drum assembly 26 and a continuous signature carrying chain 28. The main drum assembly 24 includes drum means 30 mounted for rotation on a shaft 32 extending transversely of the direction of travel of signatures 34 in the signature feeding station 22 as indicated by the arrow. The main drum assembly 24 also includes signature gripping means 36 mounted for rotation with the drum means 30 for gripping one signature 34 at a time as the signature gripping means 36 passes the signature feeding station 22. Further, the main drum assembly 30 includes means for releasing the signatures 34 from the signature gripping means 36 and stopping travel of the signatures 34 with the drum means 30.

In particular, and as described in greater detail in my copending and commonly owned application Ser. No. 179,883, filed on the same date, which is incorporated herein by reference, the releasing and stopping means includes timing means which causes the gripping means 36 to release the signatures 34 at a preselected point during travel of the signatures 34 with the drum means 30. The releasing and stopping means also includes at least a pair of spaced apart register stops 40 downstream of the preselected point by a preselected distance together with at least one bracket supported guide roller 42 in engagement with the drum means 30 to cause the signatures 34 to travel with the drum means 30 from the preselected point through the preselected distance to the register stops 40. The delivery drum assembly 26 includes a transfer drum 44 mounted for rotation in a direction opposite rotation of the main drum assembly 30 on a shaft 46 extending parallel to the shaft 32 of the main drum assembly 24. The delivery drum assembly 26 also includes means such as the air supply 48 and roller 50 cooperating with the transfer drum 44 to cause the signatures 34 to travel with the transfer drum 44 away from the register stops 40 toward the continuous signature carrying chain 28. Additionally, the delivery drum assembly 26 includes at least one gripper assembly 52 mounted for rotation with an opening drum for opening one signature at a time, and the opening drum 54 rotates in a direction opposite rotation of the transfer drum 44 on a shaft 56 extending parallel to the shaft 46 of the transfer drum 44 (see, also, FIG. 2).

Referring to FIGS. 3–6, the gripper assembly 52 includes an elongated continuously curved finger 58 for gripping one signature 34 at a time as the signature 34 passes between the transfer drum 44 and the opening drum 54. It will also be appreciated that the apparatus will include timing means 60 allowing the gripper assembly 52 to initiate gripping of signatures 34 at a first preselected point when the signature 34 is between the transfer drum 44 and the opening drum 54 and to fully grip signatures 34 at a second preselected point for opening signatures 34 so they can be disposed one at a time over the continuous signature carrying chain 28. As shown, the timing means 60 includes a cam 62 mounted in a fixed position in proximity to the opening drum 54 and a cam follower 64 operatively associated with the gripper assembly 52 and mounted for rotation with the opening drum 54.

Still referring to FIGS. 3–6, the finger 58 has a first end 66 mounted for rotation relative to the opening drum 54 and a second end 68 normally projecting beyond the outer periphery 54*a* of the opening drum 54. The finger 58 also has a continuously curved inner surface 58*a* and a continuously curved outer surface 58*b* converging adjacent the second end 68. Further, the gripper assembly 52 includes a seat 70 adapted to be engaged by the second end 68 of the finger 58 to grip the signatures 34 therebetween.

As best shown in FIGS. 3 and 4, the seat 70 is mounted for rotation with the opening drum 54 in close proximity to the finger 58. The seat 70 has a gripping surface 70*a* (see FIG. 5) positioned radially relative to the shaft 56 in a position generally corresponding to the radial extent of the outer periphery 54*a* of the opening drum 54. With this arrangement, the finger 58 is adapted to rotate relative to the gripping surface 70*a* of the seat 70 to grip the signatures 34 therebetween.

Referring to FIG. 5, the timing means 60 allows the finger 58 to rotate from a position where the second end 68 of the finger 58 normally projects beyond the opening drum 54 in spaced relation to the gripping surface 70*a* of the seat 70 to a position where the second end 68 of the finger 58 cooperates with the gripping surface 70*a* of the seat 70 to grip the signatures 34 therebetween. The difference in these positions can be best understood by comparing FIG. 5 with the position of the two gripper assemblies 52 shown in FIG. 3. Additionally, the finger 58 is disposed relative to the opening drum 54 such that the curvature adjacent the second end 68 of the finger 58 generally conforms to the curvature of the outer periphery 54*a* of the opening drum 54 when the second end 68 of the finger 58 cooperates with the gripping surface 70*a* of the seat 70 to grip the signatures 34 therebetween.

Referring specifically to FIG. 4, means are provided for rotating the finger 58 from the position where the second end 68 normally projects beyond the opening drum 54 in spaced relation to the gripping surface 70*a* of the seat 70 to the position where the second end 68 cooperates with the gripping surface 70*a* of the seat 70. Specifically, the finger rotating means includes a spring 72 which operates in a manner which will be described in greater detail hereinafter. With this arrangement, the timing means 60 allows the finger 58 to rotate so as to grip signatures 34 for opening prior to delivery to the continuous signature carrying chain 28 by reason of its profile together with the biasing force of the spring 72 and thereafter causes the finger 58 to rotate so as to release signatures 34 for delivery to the continuous signature carrying chain 28 by reason of its profile which acts against the biasing force of the spring 72.

Referring to FIG. 6, the cam 62 includes a first distinct cam portion 62*a* at the first preselected point having a profile allowing the finger 58 to rotate from the position where the second end 68 of the finger 58 normally projects beyond the opening drum 54 to a position approaching the gripping surface 70*a* of the seat 70 where the finger 58 is slightly spaced from the gripping surface 70*a* of the seat 70 prior to the point where the second end 68 of the finger 58 grips signatures 34 therebetween. It also includes a second distinct cam portion 62*b* at the second preselected point having a profile allowing the finger 58 to rotate from the position approaching the gripping surface 70*a* of the seat 70 to the position where the second end 68 of the finger 58 cooperates with the gripping surface 70*a* of the seat 70 to grip signatures therebetween. Further, the cam 62 includes a ramp 62*c* intermediate the first and second distinct cam portions 62*a* and 62*b* to introduce a delay between the position when the finger 58 partially closes and the position where the finger 58 fully closes to cooperate with the gripping surface 70*a* of the seat 70 to grip signatures 34 therebetween.

Referring to FIGS. 1, 2 and 4, the opening drum 54 includes a first drum portion 74 and a second drum portion 76 mounted for rotation on the shaft 56, and the cam 62 is mounted in spaced relation to the first and second drum portions 74 and 76. The apparatus also preferably includes a gripper assembly 52 operatively associated with each of the first and second drum portions 74 and 76 where each of the gripper assemblies 52 includes a finger 58 and a seat 70. Further, the cam follower 64 is preferably carried by a first shaft 78 supporting the fingers 58 and mounted for rotation with and relative to the first and second drum portions 74 and 76.

Still referring to FIG. 4, the fingers 58 are supported in spaced relation to the corresponding one of the first and second drum portions 74 and 76 on the first shaft 78 radially spaced from the opening drum shaft 56 and extending through the first and second drum portions 74 and 76 for rotation therewith and relative thereto. The exact position of the respective gripper assemblies 52 can best be appreciated by considering FIG. 3. As also shown in FIG. 4, the seats 70 are supported in spaced relation to the corresponding one of the first and second drum portions 74 and 76 on a second shaft 80 radially spaced from the opening drum shaft 56 and extending through the first and second drum portions 74 and 76 for rotation therewith and in fixed relation thereto.

As previously mentioned, means are provided for rotating the fingers 58 from the signature releasing position to the signature gripping position. The finger rotating means includes a bushing 82 disposed within a bore 84 in each of the first and second drum portions 74 and 76 and the first shaft 78 supporting the fingers 58 is rotatable in the bushings relative to the first and second drum portions 74 and 76. Preferably, the finger rotating means includes at least one and preferably a pair of springs 72 biasing the first shaft 78 relative to the bushings 82 toward the signature gripping position.

As will be appreciated by comparing FIGS. 3 and 4, a second gripper assembly 52 is optionally operatively associated with each of the first and second drum portions 74 and 76. Each of the gripper assemblies 52 advantageously includes a finger 58 and a seat 70 such as those described in detail hereinabove. Also, as shown, the optional two gripper assemblies 52 are arranged relative to the first and second drum portions 74 and 76 so as to be diametrically spaced relative to the first two gripper assemblies 52.

Referring to FIG. 3, the gripper assemblies 52 each preferably include a base 86 adapted to be disposed on the first shaft 78. The bases 86 which are adapted to support corresponding ones of the fingers 58 will, of course, be fixedly mounted to the respective shafts 78 for rotation therewith, and it is this rotation which causes the corresponding ones of the fingers 58 to move from the fully opened position to the fully closed or signature gripping position. Also, as shown, the seats 70 are each adapted to be fixedly mounted to the respective shafts 80.

As will be best appreciated from FIG. 5, the seats 70 each include a cutout 88 adapted to receive a urethane insert 90 that provides the gripping surface 70*a*. Thus, in the event of excessive wear, the urethane insert 90 can be removed and replaced in an economical and rapid manner. Further, it will be noted that the gripping surface 70*a* of each of the seats 70 is preferably curved to conform to the second end 68 of the corresponding one of the fingers 58.

With regard to the fingers 58, it has previously been mentioned that they have continuously curved inner and outer surfaces converging adjacent the second end 68. It will also be noted from FIG. 5 that the fingers 58 preferably converge to a point as at 58*c*. By reason of the elongated, curved, converging and pointed fingers, the gripper assemblies 52 are particularly well suited for opening signatures despite static or pinholes.

Referring to FIGS. 4 and 5, it will be seen that the cam follower 64 is carried on the first shaft 78 by means of a cam follower arm 92. The cam follower arm 92 includes a radially extending portion 92*a* and an axially extending portion 92*b* to which the cam follower 64 is secured. By means of the axially extending portion 92*b*, the cam follower 64 is disposed in contact with the surface of the cam 62.

Referring specifically to FIG. 4, the bushings 82 include collars 82*a* through which studs 78*a* project. It will be noted that the springs 72 are secured to the studs 78*a* and to the respective first and second drum portions 74 and 76 radially remote from the bushings 82 as, for instance, at 94 by any conventional means such as a cotter key 96 or the like. In this manner, the springs 72 can exert a continuous biasing force on the shaft 78 tending to force the fingers 58 to the fully closed position.

Of course, as the cam follower 64 follows the surface of the cam 62, the first shaft 78 will be caused to rotate relative to the first and second drum portions 74 and 76 which, in turn, will cause the fingers 58 of the gripper assemblies 52 to move from the fully opened position to the fully closed position wherein the second ends 68 of the fingers 58 will grip and open the signatures therebetween by separating the pages thereof. However, after the cam follower 64 passes the second preselected point on the surface of the cam 62, the cam 62 will cause the fingers 58 to once again be fully opened once the cam follower 64 reaches a third distinct cam portion 62*d* at the third preselected point to release signatures 34 from therebetween.

Figure 7:
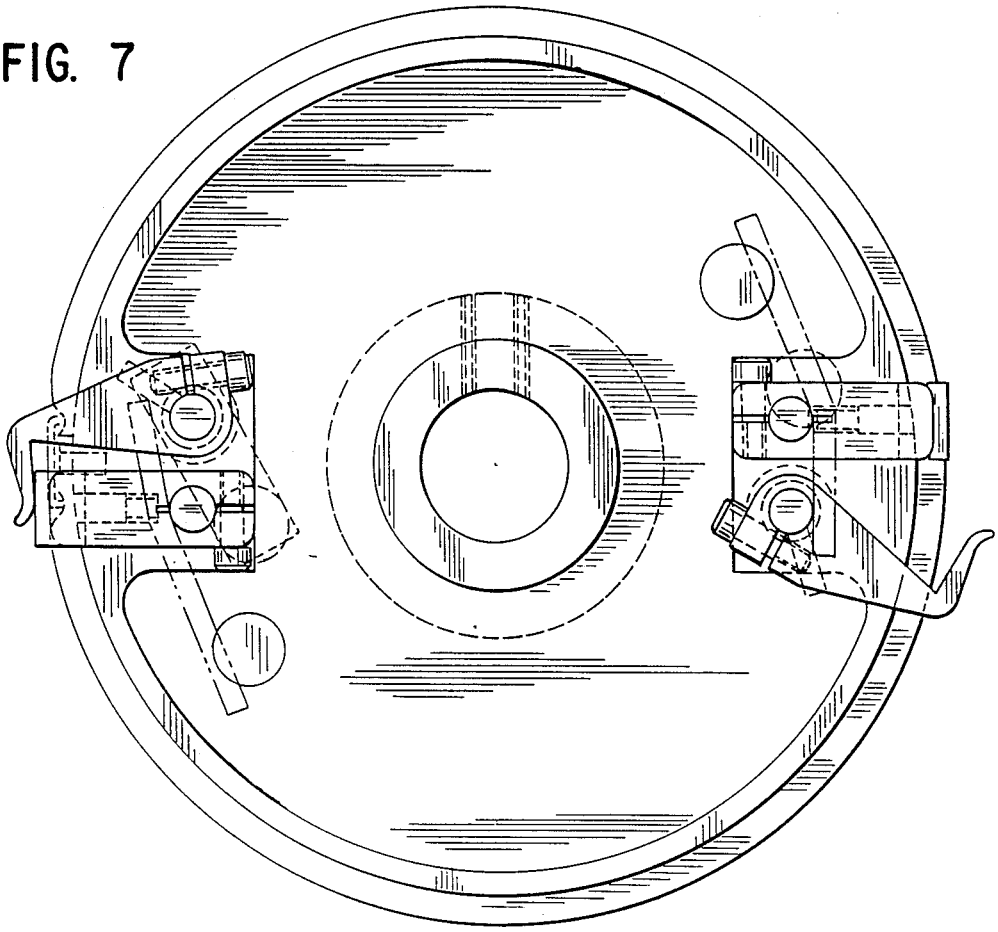
FIG. 7 is a side elevational view illustrating a signature opener in accordance with the prior art.

Referring to FIG. 7, the gripper assemblies that have previously been used are illustrated for purposes of comparison. It will immediately be appreciated that the fingers, rather than being continuously curved and having converging inner and outer surfaces, have a very abrupt angle of very nearly 90° and have a thickness and shape which renders it difficult to open signatures particularly in the presence of static or pinholes. Moreover, the fingers clearly do not have a curvature generally corresponding to the outer periphery of the opening drum when in the closed position.

In view of the foregoing, it will be appreciated how the present invention represents a significant advancement over the prior art. It is now possible for the first time to essentially insure the opening of signatures regardless of static or the presence of pinholes from impaling pins which has heretofore been considered impossible. In addition, the new gripper assemblies have a significantly greater reach permitting the gripping of even the slightest amount of paper protruding on the low folio side of a signature.

While in the foregoing there has been set forth a preferred embodiment of the invention, it will be appreciated that the invention is to be limited only by the scope and spirit of the appended claims.

I claim:

1. An apparatus for receiving one signature at a time from a source of signatures fed to said apparatus in a steady stream, said apparatus comprising:

an opening drum mounted for rotation on a shaft for delivering opened signatures to a continuous signature carrying chain, at least one gripper assembly mounted for rotation with said opening drum for opening one signature at a time, and timing means for allowing said gripper assembly to initiate gripping of signatures at a first preselected point, to fully grip and open signatures at a second preselected point, and to release open signatures at a third preselected point;

said gripper assembly including an elongated continuously curved finger, said finger having a first end mounted for rotation with and relative to said opening drum and a second end normally projecting beyond said opening drum, said finger having a continuously curved inner surface and a continuously curved outer surface, said gripper assembly also including a seat adapted to be engaged by said second end of said finger;

said timing means allowing said finger to rotate from a position where said second end of said finger normally projects beyond said opening drum in spaced relation to said seat to a position where said second end of said finger cooperates with said seat to grip signatures therebetween; and means for rotating said finger from said position where said second end of said finger normally projects beyond said opening drum in spaced relation to said seat to release signatures from therebetween to a position where said second end of said finger cooperates with said seat to grip signatures therebetween;

said timing means allowing said finger to rotate so as to initiate gripping of signatures prior to delivery to said continuous signature carrying chain at said first preselected point, said timing means temporarily interrupting rotation of said finger at said first preselected point, but later allowing said finger to rotate further so as to fully grip signatures for opening prior to delivery to said continuous signature carrying chain at said second preselected point, said timing means still later causing said finger to rotate so as to release signatures after opening for delivery to said continuous signature carrying chain at said third preselected point.

2. The apparatus as defined in claim 1 wherein said seat is mounted for rotation with said opening drum, said seat having a gripping surface positioned radially relative to said shaft in a position generally corresponding to the radial extent of the periphery of said opening drum, said finger being adapted to rotate relative to said seat to grip said signature therebetween.

3. The apparatus as defined by claim 1 wherein said finger is disposed relative to said opening drum such that the curvature adjacent said second end of said finger generally conforms to the curvature of the outer periphery of said opening drum when said second end of said finger cooperates with said seat to grip signatures therebetween.

4. The apparatus as defined by claim 1 wherein said timing means includes a cam mounted in a fixed position in proximity to said opening drum and a cam follower operatively associated with said finger and mounted for rotation with said opening drum.

5. The apparatus as defined by claim 1 including a pair of gripper assemblies, the gripper assemblies each including a finger and a seat, said gripper assemblies being diametrically spaced relative to said opening drum.

6. An apparatus for receiving one signature at a time from a source of signatures fed to said apparatus in a steady stream, said apparatus comprising:

an opening drum mounted for rotation on a shaft for delivering opened signatures to a continuous signature carrying chain, at least one gripper assembly mounted for rotation with said opening drum for opening one signature at a time, and timing means for allowing said gripper assembly to initiate gripping of signatures at a first preselected point, a fully grip and open signatures at a second preselected point and to release opened signatures at a third preselected point;

said gripper assembly including an elongated continuously curved finger, said finger having a first end mounted for rotation with and relative to said opening drum and a second end normally projecting beyond said opening drum, said finger having a continuously curved inner surface and a continuously curved outer surface converging adjacent said second end, said gripper assembly also including a seat adapted to be engaged by said second end of said finger;

said seat being mounted for rotation with said opening drum, said seat having a gripping surface positioned radially relative to said shaft in a position generally corresponding to the radial extent of the outer periphery of said opening drum, said finger being adapted to rotate relative to said seat to grip said signatures therebetween;

said timing means allowing said finger to rotate from a position where said second end of said finger normally projects beyond said opening drum in spaced relation to said gripping surface of said seat to a position where said second end of said finger cooperates with said gripping surface of said seat to grip signatures therebetween;

said finger being disposed relative to said opening drums such that the curvature adjacent said second end of said finger generally conforms to the curvature of the outer periphery of said opening drum when said second end of said finger cooperates with said gripping surface of said seat to grip signatures therebetween; and means for rotating said finger from said position where said second end of said finger normally projects beyond said opening drum in spaced relation to said gripping surface of said seat to release signatures from therebetween to said position where said second end of said finger cooperates with said gripping surface of said seat to grip signatures therebetween;

said timing means allowing said finger to rotate so as to initiate gripping of signatures prior to delivery to said continuous signature carrying chain at said first preselected point, said timing means temporarily interrupting rotation of said finger at said first preselected point, but later allowing said finger to rotate further so as to fully grip signatures for opening prior to delivery to said continuous signature carrying chain at said second preselected point, and said timing means still later causing said finger to rotate so as to release signatures after opening for delivery to said continuous signature carrying chain at said third preselected point.

7. The apparatus as defined by claim 6 wherein said timing means includes a cam mounted in a fixed position in proximity to said opening drum and a cam follower operatively associated with said finger and mounted for rotation with said opening drum.

8. The apparatus as defined by claim 7 wherein said cam includes a first distinct cam portion having a profile allowing said finger to rotate from said position where said second end of said finger normally projects beyond said opening drum to a position approaching said gripping surface of said seat where said finger is slightly spaced from said gripping surface of said seat and said cam also includes a second distinct cam portion having a profile allowing said finger to rotate from said position slightly spaced from said gripping surface of said seat to said position where said second end of said finger cooperates with said gripping surface of said seat to grip signatures therebetween.

9. The apparatus as defined by claim 8 wherein said cam includes a ramp intermediate said first and second distinct cam portions to introduce a delay between said position where said finger approaches said gripping surface of said seat to a position where said finger cooperates with said gripping surface of said seat to grip signatures therebetween.

10. The apparatus as defined by claim 6 including a pair of gripper assemblies, said gripper assemblies each including a finger and a seat, said gripper assemblies being diametrically spaced relative to said opening drum.

11. The apparatus as defined by claim 6 wherein said opening drum includes a first drum portion and a second drum portion mounted for rotation on said shaft, said apparatus including a gripper assembly operatively associated with each of said first and second drum portions, said gripper assemblies of said first and second drum portions each including a finger and a seat.

12. The apparatus as defined by claim 11 wherein said timing means includes a cam mounted in fixed position on said shaft of said opening drum in spaced relation to said first and second drum portions, said timing means also including a cam follower operatively associated with said fingers and mounted for rotation with said first and second drum portions.

13. An apparatus for receiving one signature at a time from a source of signatures fed to said apparatus in a steady stream, said apparatus comprising:

an opening drum mounted for rotation on a shaft for delivering opened signatures to a continuous signature carrying chain, said opening drum including a first drum portion and a second drum portion mounted for rotation on said shaft, a gripper assembly operably associated with each of said first and second drum portions for rotation with said first and second drum portions for opening one signature at a time, and timing means for allowing said gripper assemblies to initiate gripping of signatures at a first preselected point, to fully grip and open signatures at a second preselected point, and to release opened signatures at a third preselected point;

said gripper assemblies each including an elongated continuously curved finger, said fingers having first ends mounted for rotation relative to the corresponding ones of said first and second drum portions and second end normally projecting beyond said first and second drum portions, said fingers having continuously curved inner surfaces and continuously curved outer surface converging adjacent said second ends, said gripper assemblies each also including a seat adapted to be engaged by said second end of the corresponding one of said fingers;

said seats being mounted for rotation with said opening drum, said seats each having a gripping surface positioned radially relative to said shaft in a position generally corresponding to the radial extent of the outer periphery of said opening drum, said fingers being adapted to rotate relative to said seats to grip signatures therebetween;

said timing means allowing said fingers to rotate from a position where said second ends of said fingers normally project beyond said opening drum in spaced relation to said gripping surfaces of said seats to a position where said second ends of said fingers cooperate with said gripping surfaces of said seats to grip signatures therebetween;

said fingers being disposed relative to said opening drum such that the curvature adjacent said second ends of said fingers generally conforms to the curvature of the outer periphery of said opening drum when said second ends of said fingers cooperate with said gripping surfaces of said seats to grip signatures therebetween;

said fingers being supported in spaced relationship to the corresponding one of said first and second drum portions on a first shaft radially spaced from said opening drum shaft and extending through said first and second drum portions for rotation therewith and relative thereto, said seats being supported in space relation to said corresponding one of said first and second drum portions on a second shaft radially spaced from said opening drum shaft and extending through said first and second drum portions for rotation therewith and in fixed relation thereto; and means for rotating said fingers from said position where said second ends of said fingers normally project beyond said opening drum in spaced relation to said gripping surfaces of said seats to release signatures from therebetween to said position where said second ends of said fingers cooperate with said gripping surfaces of said seats to grip signatures therebetween;

said timing means allowing said fingers to rotate so as to initiate gripping of signatures prior to delivery to said continuous signature carrying chain at said first preselected point, said timing means temporarily interrupting rotation of said finger at said first preselected point, but later allowing said fingers to rotate further so as to fully grip signatures for opening prior to delivery to said continuous signature carrying chain at said second preselected point, and said timing means still later causing said fingers to rotate so as to release signatures after opening for delivery to said continuous signature carrying chain at said third preselected point.

14. The apparatus as defined in claim 13 wherein said timing means includes a cam mounted in spaced relation to said first and second drum portions, said timing means also including a cam follower carried by said first shaft supporting said fingers and mounted for rotation with said first and second drum portions.

15. The apparatus as defined by claim 13 wherein said finger rotating means includes a bushing disposed within a bore in each of said first and second drum portions, said first shaft supporting said fingers being rotatable in said bushings relative to said first and second drum portions in said bores therein, said finger rotating means also including at least one spring biasing said first shaft relative to said bushings toward said position where said second ends of said fingers cooperate with said gripping surfaces of said seats.

16. The apparatus as defined by claim 13 including a second gripper assembly operatively associated with each of said first and second drum portions, each of said gripper assemblies including a finger and a seat, said gripper assemblies of each of said first and second drum portions being diametrically spaced relative thereto.

* * * * *